US007210869B2

(12) United States Patent
Kageyama et al.

(10) Patent No.: US 7,210,869 B2
(45) Date of Patent: May 1, 2007

(54) CARTRIDGE TYPE STATIONERY PRODUCT

(75) Inventors: Hidehei Kageyama, Kawagoe (JP); Tadao Odaka, Kawagoe (JP)

(73) Assignee: Kotobuki & Co., Ltd., Kyoto-shi, Kyoto-Fu (JP)

( * ) Notice: Subject to any disclaimer, the term of this patent is extended or adjusted under 35 U.S.C. 154(b) by 101 days.

(21) Appl. No.: 10/896,024

(22) Filed: Jul. 22, 2004

(65) Prior Publication Data

US 2005/0074271 A1 Apr. 7, 2005

(30) Foreign Application Priority Data

Sep. 24, 2003 (JP) ..... 2003-331655

(51) Int. Cl.

| | |
|---|---|
| ***B43K 27/02*** | (2006.01) |
| ***B43K 5/00*** | (2006.01) |
| ***B43K 23/12*** | (2006.01) |
| ***B05C 1/00*** | (2006.01) |

(52) U.S. Cl. ..... 401/18; 401/17; 401/202; 401/243

(58) Field of Classification Search ..... 401/17, 401/18, 52, 195, 102, 202, 213, 243, 262
See application file for complete search history.

(56) References Cited

U.S. PATENT DOCUMENTS

| | | | | |
|---|---|---|---|---|
| 4,167,350 | A * | 9/1979 | Harris | 401/260 |
| 5,732,176 | A * | 3/1998 | Savage, Jr. | 385/92 |
| 6,554,516 | B1 * | 4/2003 | Christopher | 401/31 |

FOREIGN PATENT DOCUMENTS

| | | |
|---|---|---|
| JP | 10-81099 | 3/1998 |

* cited by examiner

*Primary Examiner*—David J. Walczak
(74) *Attorney, Agent, or Firm*—McGinn IP Law Group, PLLC

(57) ABSTRACT

In a cartridge type stationery product including a body and a cartridge attachable to and detachable from the body, the cartridge is capable of being inserted from an opening of the body, a locking groove is formed on the body, and a locking protrusion which is inserted into the locking groove is formed on the cartridge, and the locking groove is constructed by a first groove portion extending in an axial direction from a vicinity of the opening, and a second groove portion extending from the first groove portion to form an angle with the first groove portion.

18 Claims, 9 Drawing Sheets

CARTRIDGE TYPE STATIONERY PRODUCT

BACKGROUND OF THE INVENTION

1. Field of the Invention

The present invention relates to a cartridge type stationery product including an attachable and detachable cartridge.

2. Description of the Related Art

Conventionally, as a cartridge type stationery product of this kind, there is the one described in Japanese Patent Laid-Open No. 10-81099 and shown in FIG. 11. The one described in Japanese Patent Laid-Open No. 10-81099 is a correction tape coating tool, and as shown in FIG. 11, the correction tape coating tool is constructed by a body 50, and a cartridge 60 which is attachable and detachable to and from the body 50, and is a disposable and replaceable component. The cartridge 60 is inserted into the body 50 from a rear end opening 50*a* which is formed at a rear end of the body 50, and a use tip end portion 60*a* made available for use of the cartridge 60 projects from a tip end opening 50*b* which is formed at a tip end of the body 50. An elastic protuberance 60*b* of this cartridge 60 is locked at a locking hole 50*c* which is formed in the vicinity of the rear end opening 50*a*. The cartridge 60 can be detached from the body 50 by pressing a pair of elastic arm portions 60*c* provided at both ends of the cartridge 60 in the opposing directions to each other, and pulling the cartridge 60 from the body 50 while releasing the locking of the elastic protuberance 60*b* from the locking hole 50*c*.

However, the cartridge 60 is housed in the body 50 by locking of the elastic protuberance 60*b* in the locking hole 50*c*, if a restoring force of the elastic arm portion 60*c* is weak, the cartridge 60 is likely to be detached from the body 50 unexpectedly. In order to form the elastic arm portion 60*c* at the cartridge 60, it is necessary to provide a clearance for the elastic arm portion 60*c* to swing between the elastic arm portion 60*c* and the other portions of the cartridge 60, and as a result, there arises the problem that the real net capacity of the cartridge 60 is limited. Especially when the capacity of the body 50 in which the cartridge 60 should be housed is small, the net capacity of the cartridge 60 is more limited.

SUMMARY OF THE INVENTION

The present invention is made in view of the above problems, and an object of the present invention is to provide a cartridge type stationery product in which a cartridge is not unexpectedly detached and the capacity of the cartridge can be taken large, in the cartridge type stationery product.

In order to achieve the object, a cartridge type stationery product according to the present invention includes a body and a cartridge attachable to and detachable from the body, characterized in that the cartridge is capable of being inserted from an opening of the body, a locking groove is formed on one of the cartridge and the body, and a locking protrusion which is adapted to be inserted into the locking groove is formed on the other of the cartridge and the body, and the locking groove comprises a first groove portion extending from a vicinity of the opening in a cartridge insertion direction, and a second groove portion extending from the first groove portion so as to form an angle with the first groove portion.

According to the present invention, on mounting the cartridge into the body, when the cartridge is inserted with respect to the body as the locking protrusion is inserted into the locking groove, the locking protrusion moves in the first groove portion, and after the locking protrusion reaches the end portion of the first groove portion, the cartridge is twisted and rotated with respect to the body, whereby the locking protrusion moves to the second groove portion. When the locking protrusion moves to the second groove portion, the cartridge cannot be moved even if the cartridge is tried to move in the both directions of the insertion direction with respect to the body, and thereby the cartridge can be mounted into the body reliably. When the cartridge is detached from the body, the reverse operation is performed. The cartridge is not easily detached from the body because such twist, namely, rotating manipulation is required. The cartridge is fixed to the body by the locking of the locking groove and the locking protrusion, and since an elastic arm portion is not used, the clearance for the elastic arm portion to swing can be made unnecessary, thus making it possible to take the net capacity of the cartridge large.

A cap can be detachably attached to a use tip end portion which is projected from the body of the cartridge. The cartridge can be prevented from being detached unexpectedly when the cap is attached or detached.

The cap may be incapable of rotating with respect to the body in the attached state. Because the cap is incapable of rotating with respect to the body, the cartridge can be reliably prevented from being detached unexpectedly when the cap is attached and detached.

The cap can cover the locking groove and locking protrusion in the attached state. Since the cap covers the locking groove and the locking protrusion, the outer appearance in the cap attached state can be made favorable.

The cap can include an ear portion extending to an outside of the body in the attached state. The ear portion can be used as the manipulation portion when the cap is attached and detached, and favorable manipulability can be obtained.

The ear portion can cover the locking groove and the locking protrusion from outside. Since the ear portion of the cap covers the locking groove and the locking protrusion, the outer appearance in the cap fitted state can be made favorable.

In one of the cartridge and the body on which the locking groove is formed, an opening may be formed in the vicinity of the second groove portion. When the locking protrusion moves to the second groove portion, the opening in the vicinity of the second groove portion is contracted, and the locking protrusion can move by pushing and widening the second groove portion instead. As a result, the groove width at the boundary portion between the first groove portion and the second groove portion, or the groove width of the second groove portion can be set to be small with respect to the locking protrusion, and thereby it is made possible to give manipulation feeling to the user. The locking protrusion can be fitted into the second groove portion.

A narrow width portion whose groove width may be smaller than an outer diameter of the locking protrusion is formed at a boundary portion between the first groove portion and the second groove portion. When the locking protrusion is moved from the first groove portion to the second groove portion, manipulation feeling can be given, and it is made possible to notify the user that the locking protrusion enters the second groove portion reliably. It is also possible to prevent the locking protrusion from releasing from the second groove portion to the first groove portion unexpectedly.

A cushion portion can be provided between an insertion end of the cartridge and an internal part of the body, so that the cartridge is biased in a releasing direction from the body by the cushion portion. Even if the dimensional difference exists between the locking protrusion and the locking groove in the locking state, both of the locking protrusion and the locking groove are biased to abut to each other by the cushion portion, and therefore rattling can be prevented.

The cushion portion of the invention can be formed integrally at the insertion end of the cartridge. An increase in the number of components can be prevented. Alternatively, the cushion portion can be a spring interposed between the insertion end of the cartridge and the internal part of the body.

The present disclosure relates to subject manner contained in Japanese Patent Application No. 2003-331655, filed on Sep. 24, 2003, which is expressly incorporated herein by reference in its entirety.

DETAILED DESCRIPTION OF THE PREFERRED EMBODIMENTS

Figure 1:
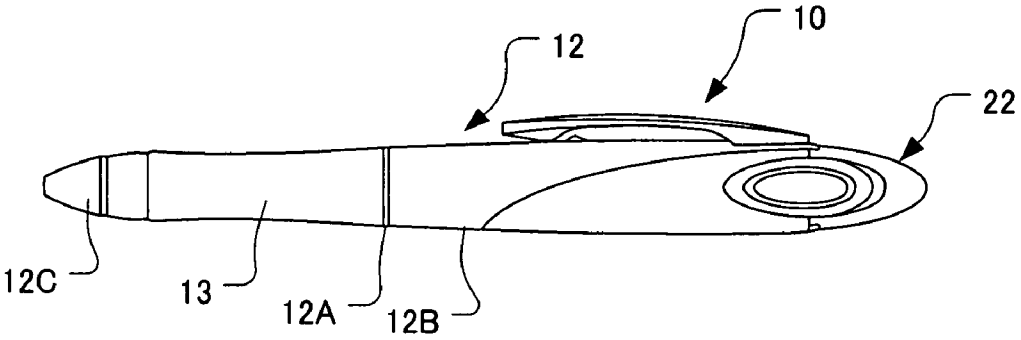
FIG. 1 is an overall view of a cartridge type stationery product according to the present invention.

Hereinafter, embodiments of the present invention will be explained referring to the drawings.

Figure 2:
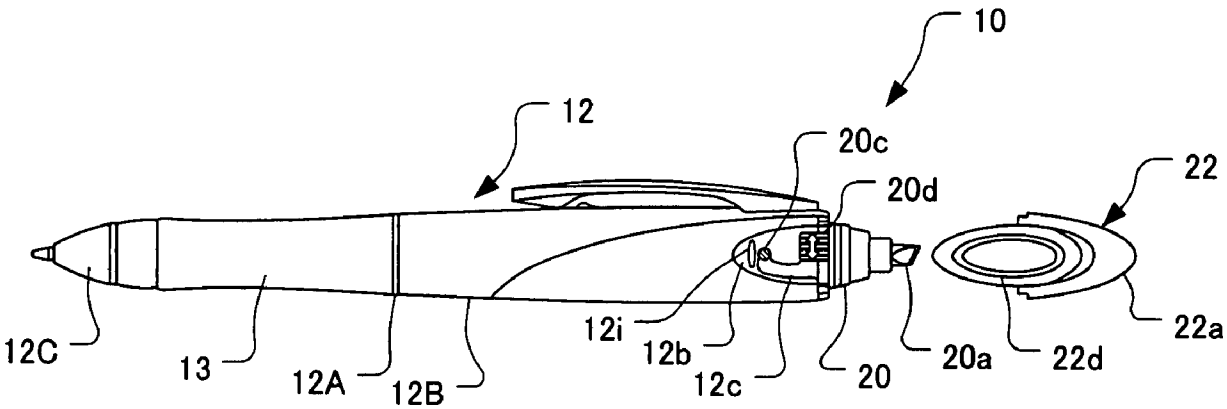
FIG. 2 is an overall view showing a state in which a cap in FIG. 1 is separated from a body and a cartridge.
Figure 3:
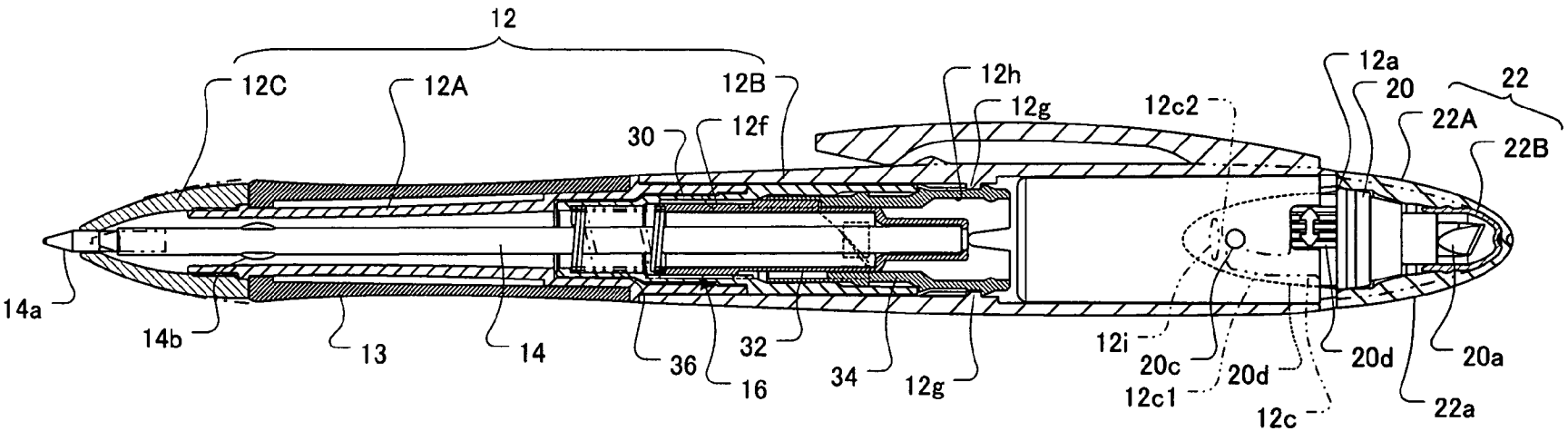
FIG. 3 is a longitudinal cross-sectional view of the cartridge type stationery product in FIG. 1.
Figure 4:
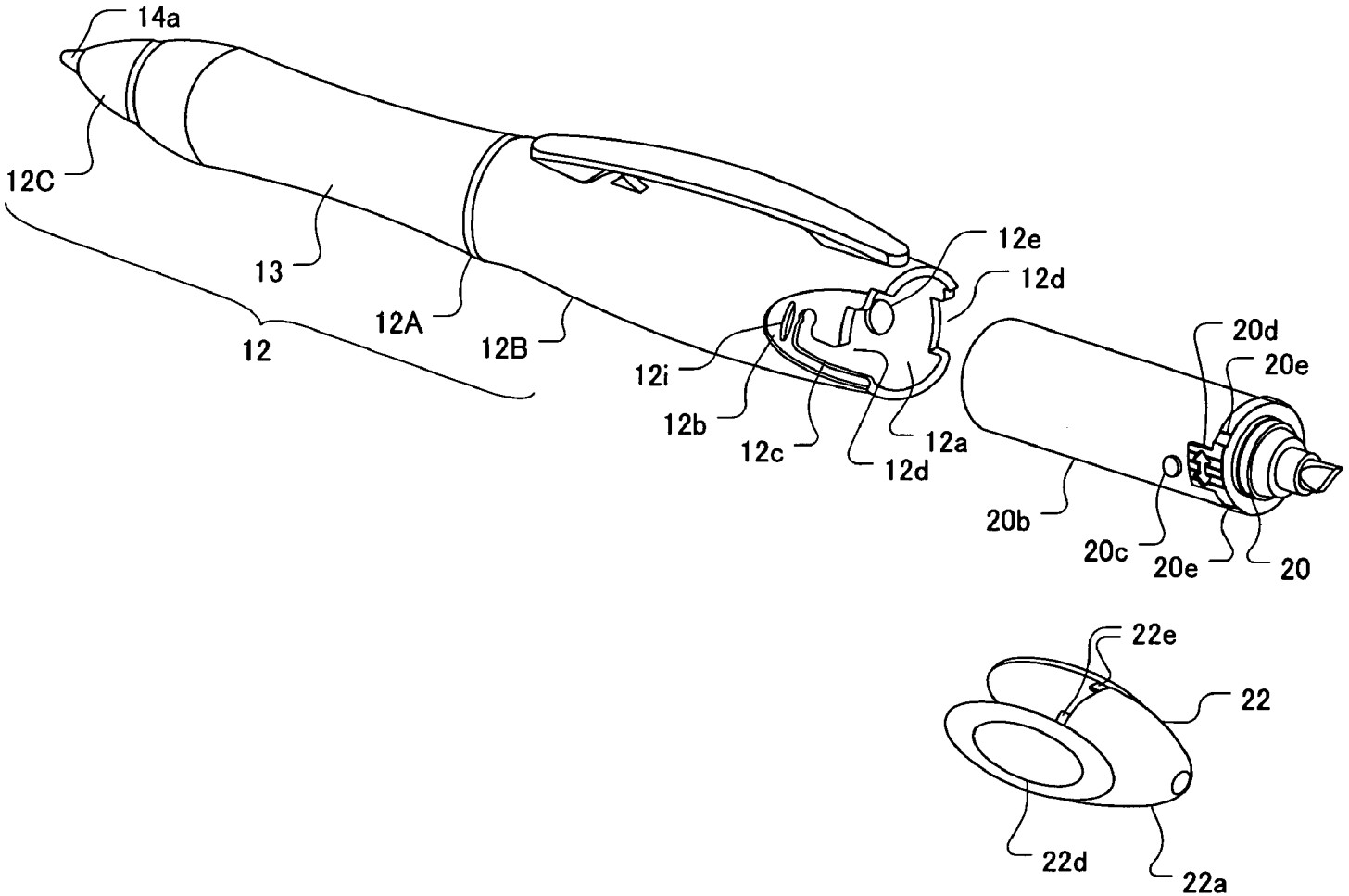
FIG. 4 is an exploded perspective view of the cartridge type stationery product according to the present invention.

FIG. 1 is an overall view of a cartridge type stationery product according to the present invention, and FIG. 2 is a view showing a state in which a cap is separated from a body and a cartridge. In the drawings, a cartridge type stationery product 10 has a body 12 constructing a writing instrument and a cartridge 20 of a stationery product attachable to and detachable from the body 12. A use (writing) tip end portion 14*a* of a ball point pen refill 14 (see FIG. 3) which is housed inside the body 12 is projected from one end portion of the body 12, and a use tip end portion 20*a* of the cartridge 20 which is inserted into the body 12 is projected from the other end of the body 12.

In the following explanation, the explanation is made with the cartridge 20 mainly, and the side on which the use tip end portion 20*a* of the cartridge 20 is projected is referred to be a foremost side (front side) while the side on which the use tip end portion 14*a* of the ball point pen refill 14 is projected is referred to be a rear side.

In the case of this example, the cartridge 20 is a marker tool, but the cartridge 20 is not limited to this, and the cartridge 20 can be any replaceable and refillable cartridge of a stationery product such as a correction, adhesive or fluorescent highlighter tape coating tool.

A body 12 has a first barrel 12A, a second barrel 12B and a taper barrel 12C which are connected to one another to construct one barrel. An elastic grip 13 is attached to an outer peripheral surface of the first barrel 12A. It is possible to construct the first barrel 12A and the taper barrel 12C integrally, but in this example, the first barrel 12A and the taper barrel 12C are attachably and detachably screwed in each other.

Figure 5A:
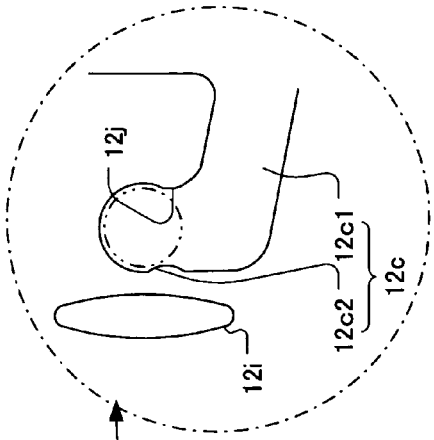
FIG. 5A is a side view of the body.
Figure 5A:
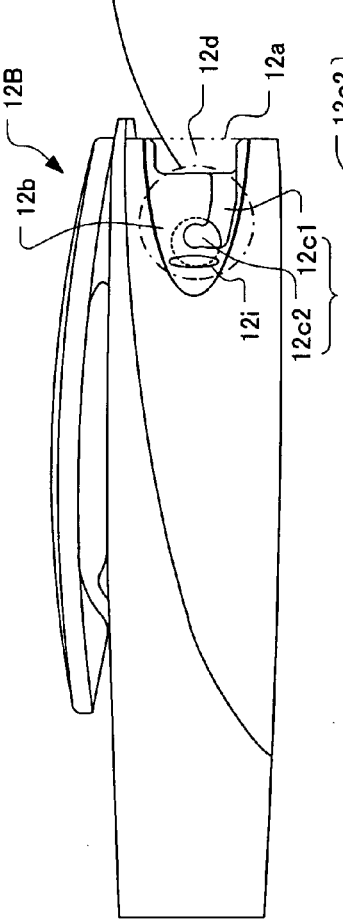
Figure 5B:
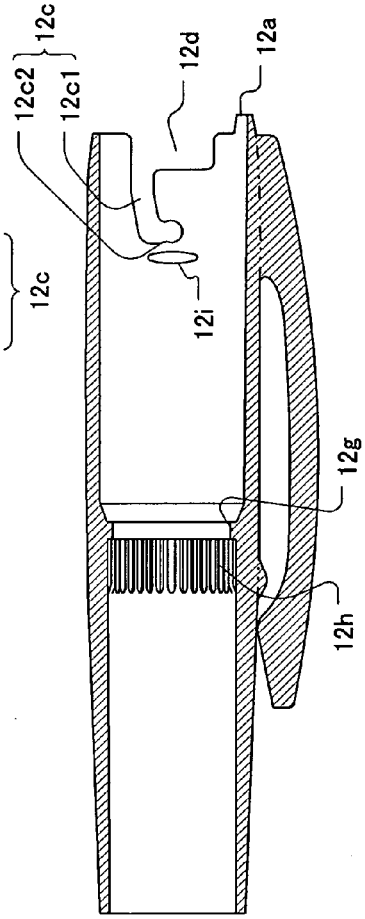
FIG. 5B is a longitudinal cross-sectional view.
Figure 5C:
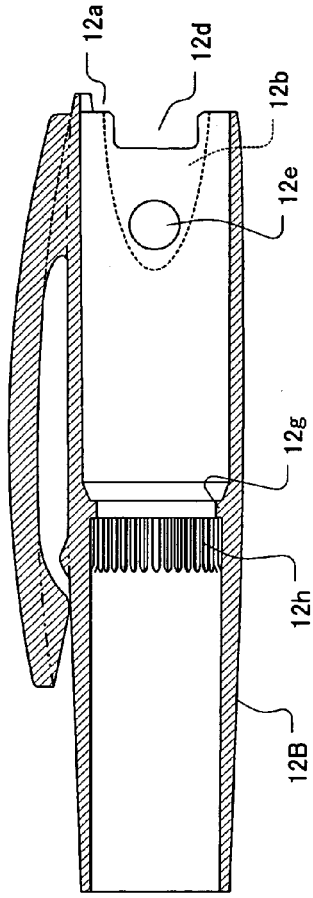
FIG. 5C is a longitudinal cross-sectional view seen from the reverse direction from FIG. 5B.

As shown in FIGS. 5A, 5B and 5C, at a side surface portion of a tip end of the second barrel 12B of the body 12, a pair of semi-elliptical thin portions 12*b* and 12*b* opposing to each other are formed in the vicinity of a tip end opening 12*a*, and a notch 12*d* and a locking groove 12*c* are formed in one of the thin portions 12*b*. The locking groove 12*c* is comprised of a first groove portion 12*c*1 extending in an axial direction from the notch 12*d* in the vicinity of the tip end opening 12*a* to the rear, and a second groove portion 12*c*2 which is connected to a rear end of the first groove 12*c*1 and forms an angle with the first groove portion 12*c*1. The first groove portion 12*c*1 extends in an insertion direction of the cartridge 20, namely, in an approximately axial direction of the cartridge 20, but "the insertion direction" here may not strictly correspond to the axial direction, and it also includes the direction having a small angle with respect to the axial direction, as shown in the drawing. On the other hand, a significant angle difference exists between the second groove portion 12*c*2 and the first groove portion 12*c*1 instead of a small difference. In this example, the second groove portion 12*c*2 extends in the direction approximately perpendicular to the axial direction. It is preferable that a boundary portion of the first groove portion 12*c*1 and the second groove portion 12*c*2 becomes a narrow width portion 12*j*. The narrow width portion 12*j* can be formed by expanding both sides of the groove.

Furthermore, in the one thin portion 12*b*, an opening 12*i* is formed in parallel with the second groove portion 12*c*2. The opening 12*i* is not limited to the closed opening as shown in the drawing, but may extend to the notch 12*d* or the like to open.

A notch 12*d* and a manipulation window 12*e* for having an access to the cartridge 20 which is inserted into the body 12 if necessary are formed in the other thin portion 12*b*.

Figure 6:
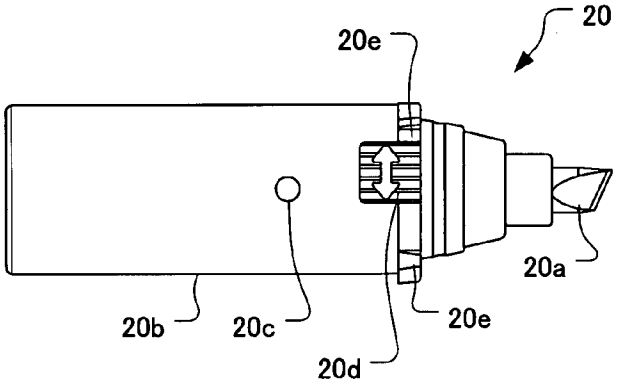
FIG. 6 is a side view of a cartridge.

As shown in FIG. 6, on a side surface portion of a case 20*b* of the cartridge 20, a locking protrusion 20*c* which is inserted into the locking groove 12*c* is formed, a pair of releasing buttons 20*d* and 20*d* which are inserted into a pair of notches 12*d* and 12*d* of the body 12 and are to be manipulated to move the locking protrusion 20*c* are formed, and further engaging recessed portions 20*e* and 20*e* are formed adjacently to the releasing buttons 20*d* and 20*d* in the circumferential direction. Corrugation and an arrow indicating the manipulation direction are provided on the surface of the releasing buttons 20*d* to facilitate the manipulation.

Figure 7A:
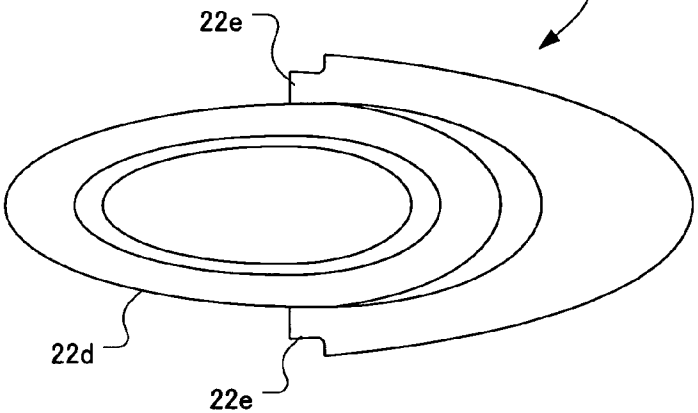
FIG. 7A is a side view of a cap.
Figure 7B:
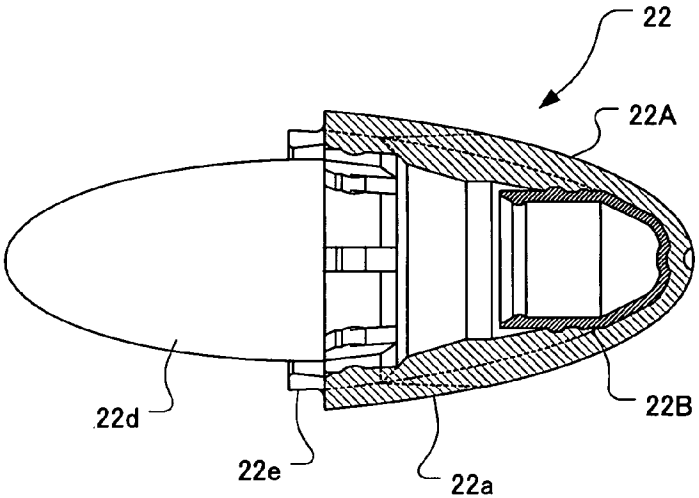
FIG. 7B is a longitudinal cross-sectional view.

A cap 22 for protecting the use tip end portion 20*a* of the cartridge 20 when it is not used is fitted on the cartridge 20. The cap 22 is constructed by an outer cap 22A and an inner cap 22B as shown in FIGS. 7A and 7B. The outer cap 22A has a cap body 22*a*, a pair of ear portions 22*d* and 22*d* which are formed on a side surface portion of the cap body 22*a* and extend rearward, and protrusions 22*e* and 22*e* placed on both sides of the ear portions 22*d* and 22*d*. The cap body 22*a* envelops the use tip end portion 20*a* together with the inner cap 22B, and is enabled to be fitted in an annular groove formed in the vicinity of the use tip end portion 20*a* of the cartridge 20. It is preferable that the outer cap 22A is constructed by a molded product of comparatively hard plastic and that the inner cap 22B is constructed by a molding product of comparatively soft plastic, such as polypropylene, polyethylene resin, for example, and thereby the soft inner cap 22B is in close contact with a periphery of the use tip end portion 20*a* of the cartridge 20 to be able to secure air tightness.

The ear portions 22*d* and 22*d* extend to an outside of the body 12 to cover the thin portions 12*b* and 12*b* of the body 12 from outside, in the fitted state in which the cap 22 is fitted on the cartridge 20. Namely, one of the ear portions 22*d* covers the locking groove 12*c* and the locking protrusion 20*c* which is inserted into the locking groove 12*c*, and the other ear portion 22*d* covers the manipulation window 12*e*. It is preferable that a corrugation, a mark, a pattern and the like are provided on the surfaces of the ear portions 22*d* and 22*d* to provide favorable manipulability.

The protrusions 22*e* and 22*e* are inserted into the engaging recessed portions 20*e* and 20*e* of the cartridge 20 in the fitted state in which the cap 22 is fitted onto the cartridge 20.

Figure 8:
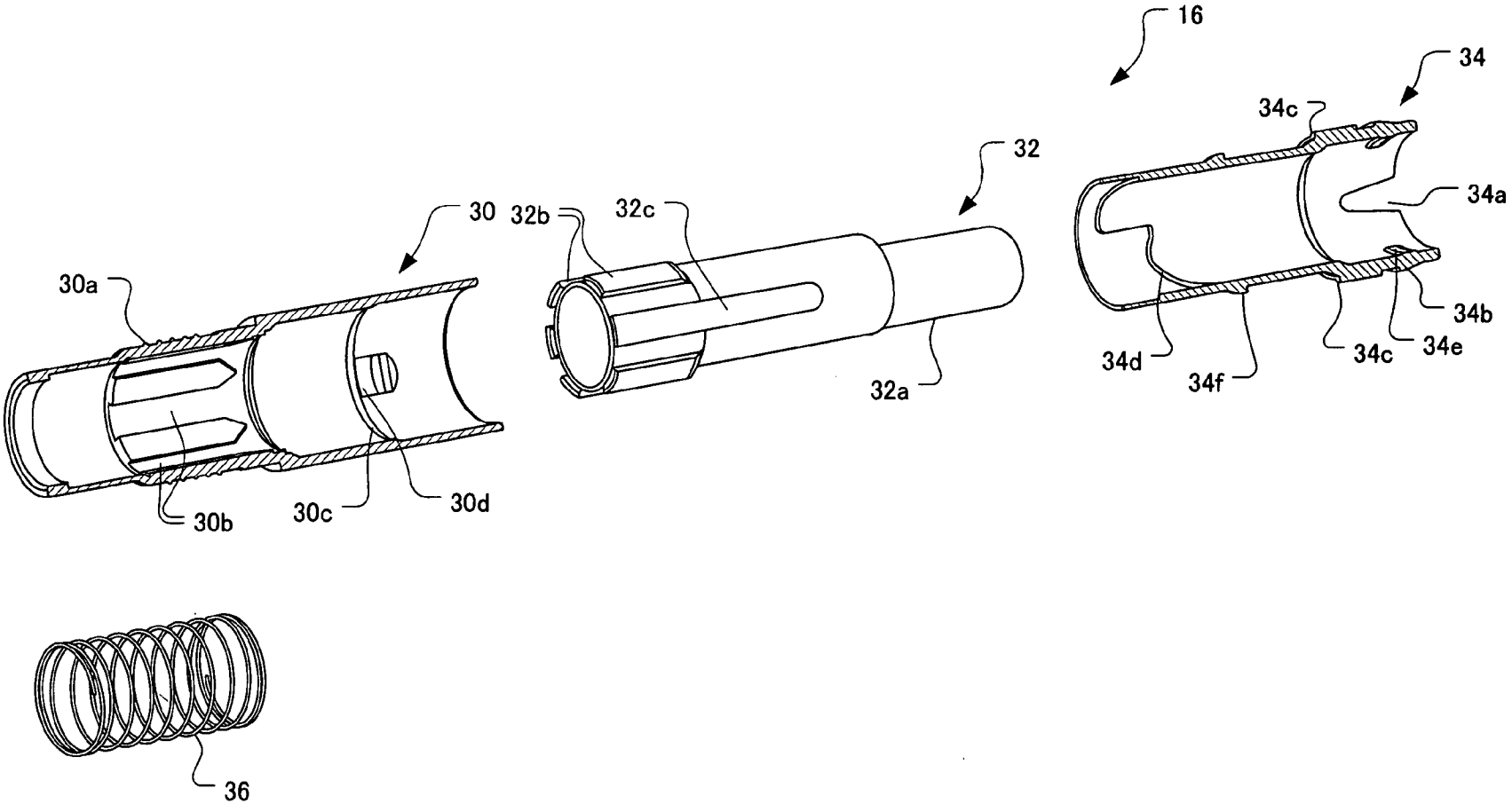
FIG. 8 is an exploded perspective view of a projecting and retracting mechanism (as for a third barrel and a cam body, a perspective view with a half of them being removed)

Next, a projecting and retracting mechanism 16 for projecting and retracting the ballpoint pen refill 14 is placed inside the body 12 constructing the writing instrument. As shown in FIG. 8, the projecting and retracting mechanism 16 is constructed by a third barrel 30 connected to the first barrel 12A, a slide cam 32 connected to a terminal end portion of the refill 14, a cam body 34 which is fixed to an inner peripheral surface of the second barrel 12B and moves the slide cam 32 in the axial direction, and a return spring 36.

In the third barrel 30, a male threaded portion 30*a* for being screwed into a female threaded portion 12*f* (see FIG. 3) of the first barrel 12A is formed on a part of an outer peripheral surface of the third barrel 30, and a plurality of key grooves 30*b* are formed on an inner peripheral surface of the third barrel 30. A step portion 30*c* is formed on an inner peripheral surface of the third barrel 30, and an opening 30*d* is formed adjacently to the step portion 30*c*.

In the slide cam 32, a reduced diameter portion 32*a* into which the terminal end portion of the refill 14 is inserted and integrally connected is formed on one end portion of the slide cam 32, and a plurality of keys 32*b* engaged with the key grooves 30*b* of the third barrel 30 and one cam protrusion 32*c* are formed on a part of an outer peripheral surface of the slide cam 32.

In the cam body 34, a slit 34*a* is formed at one end portion, a circumferential protrusion 34*b* is formed on an outer peripheral surface where the slit 34*a* is not formed to overlap the slit 34*a*, a plurality of keys 34*c* are formed on the outer peripheral surface adjacent to the circumferential protrusion 34*b*, and an annular protrusion 34*f* is formed on the outer peripheral surface spaced apart from the keys 34*c*. A cam surface 34*d* for moving the slide cam 32 in the longitudinal direction is formed on an inner peripheral surface of the cam body 34. A small protrusion 34*e* by undercutting is formed on a portion of the inner peripheral surface of the cam body 34, which is near the cartridge.

The return spring 36 is interposed between the front end portion of the third barrel 30 and the slide cam 32 in order to urge the slide cam 32 and the ball point pen refill 14 connected to the slide cam 32 to the rear. However, it is possible to provide the return spring 36 between a step portion inside the taper barrel 12C and a spring receiving portion 14*b* formed on the ball point pen refill 14, instead of this position.

The above third barrel 30, slide cam 32, cam body 34 and return spring 36 are assembled as follows. First, a part of the slide cam 32 is inserted into the cam body 34 in a manner that an end portion of the cam protrusion 32*c* of the slide cam 32 abuts against the cam surface 34*d* of the cam body 34. The return spring 36 is inserted into the third barrel 30. In this state, parts of the slide cam 32 and the cam body 34 are inserted into the third barrel 30, then, the annular protrusion 34*f* of the cam body 34 is inserted between the step portion 30*c* of the third barrel 30 and the end edge of the opening 30*d*, thereby the cam body 34 is locked to be relatively rotatable with respect to the third barrel 30. At the same time, the keys 32*b* of the slide cam 32 are fitted in the key grooves 30*b* of the third barrel 30. The slide cam 32 is inserted between the third barrel 30 and the cam body 34 inside the third barrel 30 and mounted so as to rotate integrally with the third barrel 30, and the projecting and retracting mechanism 16 made up of these third barrel 30, slide cam 32, cam body 34 and return spring 36 becomes a projecting and retracing unit which is integrally unitized.

The projecting and retracting unit is inserted into the second barrel 12B, and thereby the circumferential protrusion 34*b* of the cam body 34 is locked at a step portion 12*g* (FIGS. 5B and 5C) formed in the second barrel 12B. At this time, the keys 34*c* of the cam body 34 are fitted in any of a number of key grooves 12*h* formed on the second barrel 12B simultaneously, so that the cam body 34 rotates integrally with the second barrel 12B. The slit 34*a* of the cam body 34 is to compress one end portion of the cam body 34 when the circumferential protrusion 34*b* passes over the step portion 12*b* of the second barrel 12B upon assembly. The step portions 12*g* and the key grooves 12*h* of the second barrel 12B are interposed between the cam body 34 and the third barrel 30 of this projecting and retracting unit, whereby the projecting and retracting unit is attached to the second barrel 12B.

The male threaded portion 30*a* of the third barrel 30 in the projecting and retracting unit screws into the female threaded portion 12*f* of the first barrel 12A, whereby the first barrel 12A and the second barrel 12B are connected. When the second barrel 12B is rotated with respect to the first barrel 12A, relative rotation occurs between the cam body 34 rotating integrally with the second barrel 12B and the slide cam 32 rotating integrally with the third barrel 30 screwed into the first barrel 12A, and the cam protrusion 32*c* of the slide cam 32 moves along the cam surface 34*d* of the cam body 34, whereby the slide cam 32 moves in the axial direction. The refill 14 integrally connected to the slide cam 32 projects from the tip end of the taper barrel 12C against the spring force of the return spring 36, or retracts into the taper barrel 12C with the help of the spring force of the return spring 36, in accordance with the rotating direction of the second barrel 12B with respect to the first barrel 12A.

In the cartridge type stationery product 10 constructed as above, when the cartridge 20 is set in the body 12, the cartridge 20 is inserted into the tip end opening 12*a* of the second barrel 12B of the body 12. After the locking protrusion 20*c* of the cartridge 20 is inserted into the first groove portion 12*c*1 of the locking groove 12*c* of the second barrel 12B and moved to the end portion of the first groove portion 12*c*1, the cartridge 20 is twisted and rotated with respect to the body 12, and then, the locking protrusion 20*c* is moved to the second groove portion 12*c*2. At this time, resistance is given to the insertion of the locking protrusion 20*c* by the narrow width portion 12J existing at the boundary portion of the first groove portion 12*c*1 and the second groove portion 12*c*2, and the resistance becomes the manipulation feeling, which can notify a user that the cartridge 20 is reliably set in the body 12. When the locking protrusion 20*c* moves to the second groove portion 12$c$2, the opening 12$i$ in the vicinity of the second groove portion 12$c$2 contracts to make it possible to move the locking protrusion by pushing and widening the narrow width portion 12; and the second groove portion 12$c$2. As a result, the groove width of the narrow width portion 121 and the second groove portion 12$c$2 can be set to be small enough relative to the locking protrusion 20$c$, and the locking protrusion 20$c$ is fitted into the second groove portion 12$c$2, so that the locking protrusion 20$c$ cannot be unexpectedly detached from the second groove portion 12$c$2.

After the cartridge 20 is set in the body 12, the cap 22 is attached to the cartridge 20. The protrusions 22$e$ and 22$e$ of the cap 22 abut against the vertical wall edge in the vicinity of the tip end opening 12$a$ of the body 12, so that the cap 22 becomes incapable of rotating with respect to the body 12. Accordingly, the cap 22 cannot rotate with respect to the body 12 in the state in which the cap 22 is attached to on the cartridge, and therefore the cartridge 20 to which the cap 22 is attached does not rotate with respect to the body 12 following the movement at the time of attaching and detaching of the cap 22. The ear portions 22$d$ of the cap 22 cover the locking protrusion 20$c$, the locking groove 12$c$ and the releasing buttons 20$d$ in the state in which the cap 22 is attached to the cartridge, in addition to which, the cap 22 covers all the portions of the cartridge 20, which are exposed from the body 12, and direct access to the cartridge 20 is impossible. Accordingly, in the state in which the cap 22 is attached to the cartridge, the cartridge 20 cannot be directly manipulated, and the cartridge 20 cannot be rotated with respect to the cap 22.

Next, in order to use the use tip end portion 20$a$ of the cartridge 20, the cap 22 is pulled out, and the cap body 22$a$ and the annular groove in the vicinity of the use tip end portion 20$a$ are disengaged from each other. When the cap 22 is being pulled out, it is preferable that the ear portions 22$d$ and 22$d$ of the cap 22 are used as the manipulating portions and these are grasped and pulled out. When the ear portions 22$d$ and 22$d$ are moved, they are moved in the different direction from the direction in which the cartridge 20 rotates, the cartridge 20 is not unexpectedly detached.

In this manner, the use tip end portion 20$a$ of the cartridge 20 is exposed and is available for use.

When the content of the cartridge 20 runs out and the cartridge needs to be replaced, the cap 22 is removed first. Then, after the cartridge 20 is rotated with respect to the body 12, and the locking protrusion 20$c$ is moved to the first groove portion 12$c$1 from the second groove portion 12$c$2 of the locking groove 12$c$, the cartridge 20 is moved in the exact direction opposite to the insertion direction, and thereby the cartridge 20 is detached from the body 12.

As described above, in this embodiment, when the cartridge 20 is mounted in the body 12, the locking protrusion 20$c$ is inserted into the second groove portion 12$c$2, and therefore even if the cartridge 20 is moved in both directions of the insertion direction with respect to the body 12, the cartridge cannot be moved, thus making it possible to reliably keep the fixed state of the cartridge 20 to the body 12. Since the elastic arm portion or the like is not formed on the cartridge 20, the cartridge 20 is not unexpectedly detached, and the vacant space inside the body 12 can be sufficiently utilized as the net capacity of the cartridge 20, thus making it possible to secure the net capacity of the cartridge 20 to be larger.

Even if the cap 22 is detached in the state in which the cap 22 is attached to the cartridge 20, the cartridge 20 does not follow the movement of the cap 22, and the cartridge 20 is not unexpectedly detached from the body 12.

The cartridge 20 is not limited to those of the same kind, but the cartridge 20 can be replaced with another cartridge of a correction, an adhesive, or a fluorescent highlighter tape coating tool.

When the ball point pen refill 14 is used, it is used by rotating the second barrel 12B with respect to the first barrel 12A. As a result, as described above, the relative rotation occurs between the slide cam 32 and the cam body 34, the cam protrusion 32$c$ of the slide cam 32 moves along the cam surface 34$d$ of the cam body 34, and the slide cam 32 and the ball point pen refill 14 project and retract.

Figure 9:
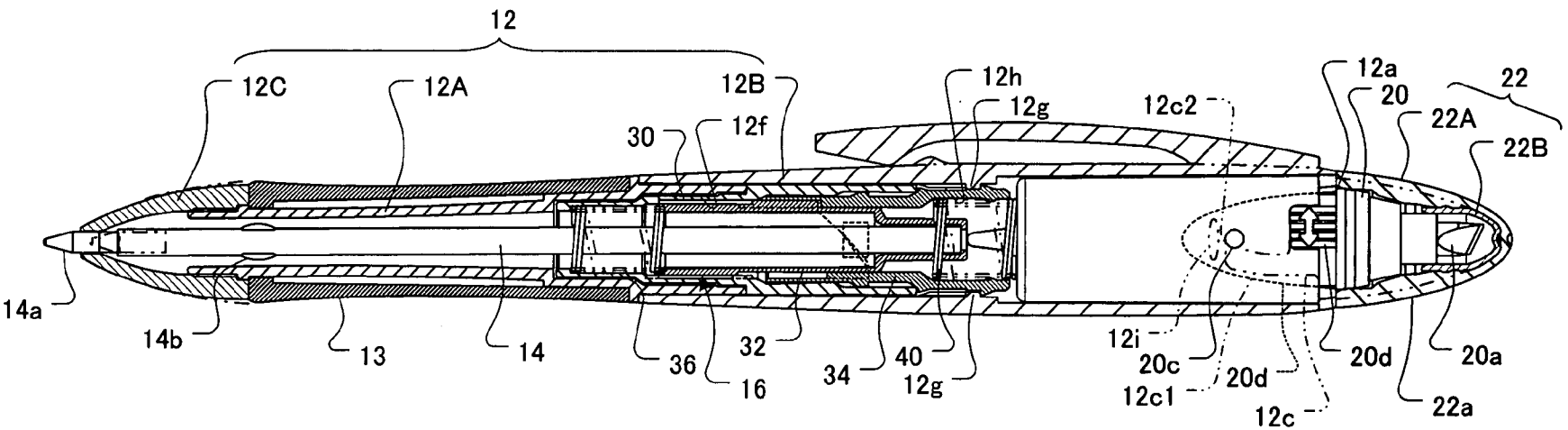
FIG. 9 is a longitudinal cross-sectional view showing another embodiment of the present invention.

FIG. 9 shows another embodiment of the present invention. This example differs from the aforementioned embodiment in the point that a spring 40 as a cushion portion is provided between the cartridge 20 and the internal mechanism in the body 12, more specifically, between the inner peripheral step portion of the cam body 34 and the end portion of the cartridge 20. This spring 40 is interposed between the inner peripheral step portion of the cam body 34 and the end portion of the cartridge 20, and always presses the cartridge 20 to the tip end opening 12$a$, and in the state in which the cartridge 20 is set in the body 12, the spring 40 presses the locking protrusion 20$c$ against the locking groove 12$c$, namely, inside the second groove portion 12$c$2 to prevent the locking protrusion 20$c$ from rattling in the second groove portion 12$c$2. When the cartridge 20 is detached, the spring 40 is caught by the small protrusion 34$e$ by undercutting formed on the cam body 34, and thereby the spring 40 is prevented from dropping. According to this embodiment, it is possible to omit the opening 12$i$.

Figure 10:
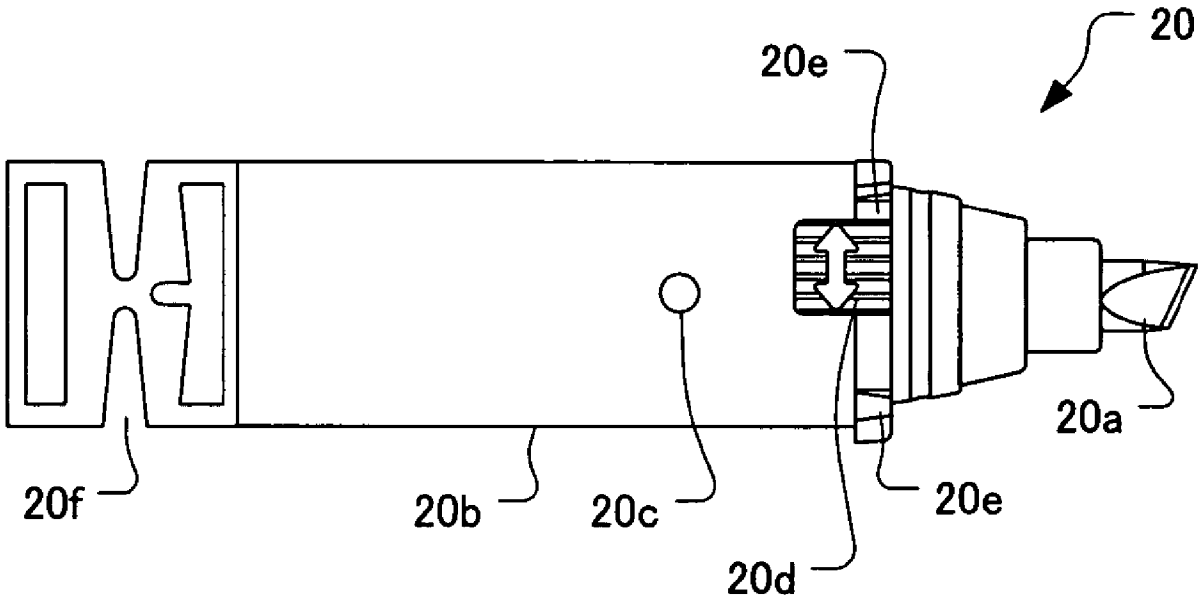
FIG. 10 is a side view of a cartridge of still another embodiment of the present invention.
Figure 11:
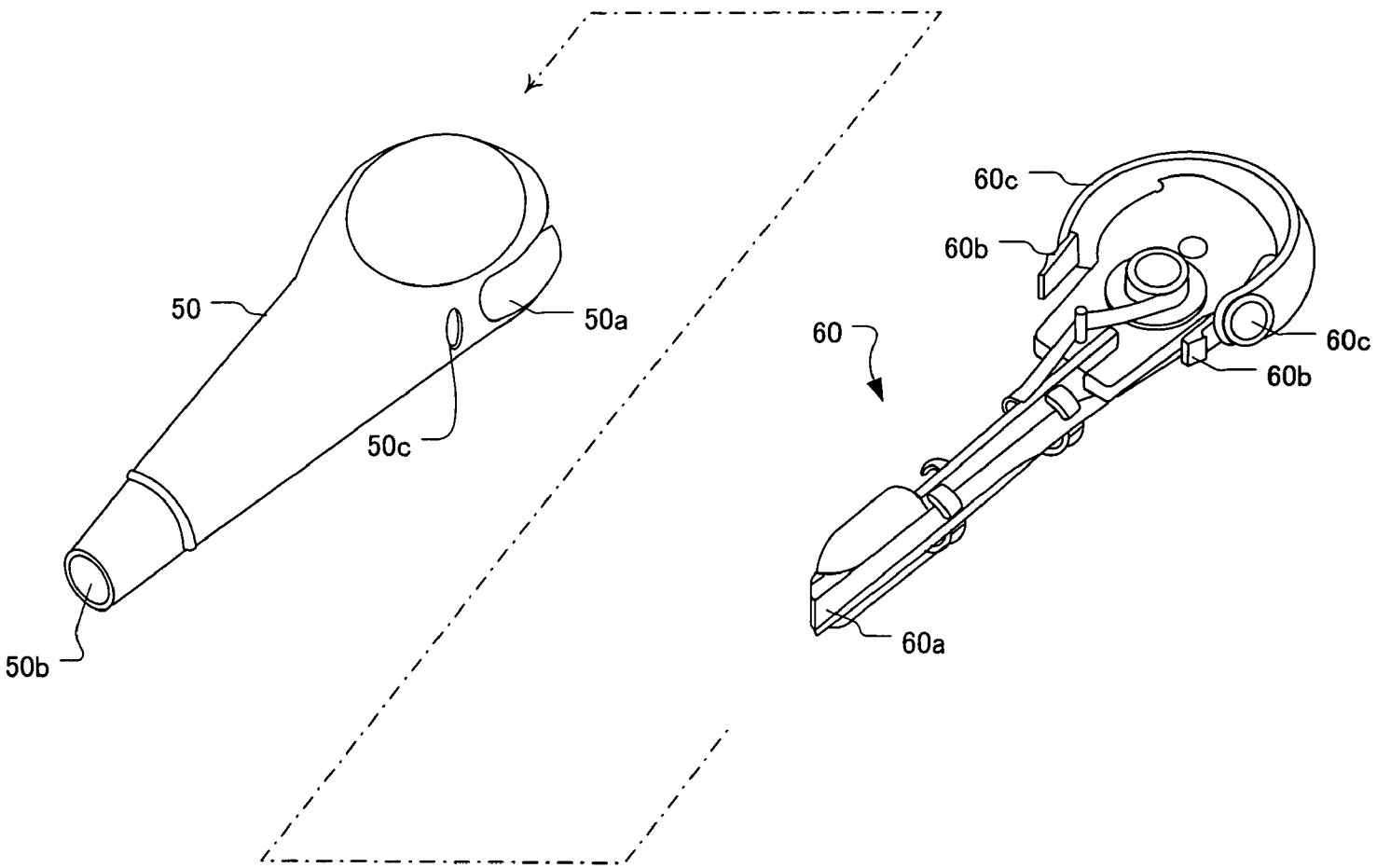
PRIOR ART FIG.11
FIG. 11 is an exploded perspective view of a conventional cartridge type stationery product.

FIG. 10 shows another embodiment of the present invention. This example differs from the example in FIG. 9 in that a cushion portion 20$f$ is integrally formed at the insertion end of the cartridge 20. The cushion portion 20$f$ is constituted of a plurality of slits formed in the insertion end portion of the cartridge 20. The cushion portion 20$f$ is allowed to abut against the internal mechanism inside the body 12 in this manner, whereby the same operation and effects as in the case in which the spring is provided as the cushion portion in FIG. 9 can be obtained, and since the cushion portion 20$f$ is integrated with the cartridge 20, an increase in the number of components can be prevented.

While the principles of the invention have been described above in connection with specific embodiments, and particular modifications thereof, it is to be clearly understood that this description is made only by way of example and not as a limitation on the scope of invention.

What is claimed is:

1. A cartridge type stationery product, comprising:

a body;

a cartridge attachable to and detachable from the body, the cartridge being insertable from an opening of the body;

a locking groove formed on one of the cartridge and the body; and a locking protrusion, adapted to be insertable into the locking groove, formed on the other one of the cartridge and the body; wherein said locking groove comprises a first groove portion extending from a vicinity of the opening in a cartridge insertion direction, and a second groove portion extending from the first groove portion so as to form an angle with the first groove portion, a can is detachably attached to a use tip end portion of the cartridge, which is projected from the body, and said cap is incapable of rotating with respect to the body in an attached state.

2. The cartridge type stationery product according to claim 1, wherein said cap covers said locking groove and locking protrusion in the attached state.

3. The cartridge type stationery product according to claim 1, wherein said cap includes an ear portion extending to an outside of the body in the attached state.

4. The cartridge type stationery product according to claim 3, wherein said ear portion covers said locking groove and said locking protrusion from outside.

5. The cartridge type stationery product according to claim 4, wherein said ear portion covers a releasing member disposed on the cartridge.

6. The cartridge type stationery product according to claim 1, wherein in one of the cartridge and the body on which said locking groove is formed, an opening is formed in the vicinity of said second groove portion.

7. The cartridge type stationery product according to claim 1, wherein a narrow width portion whose groove width is smaller than an outer diameter of the locking protrusion is formed at a boundary portion between the first groove portion and the second groove portion.

8. The cartridge type stationery product according to claim 1, wherein a cushion portion is provided between an insertion end of the cartridge and an internal part of the body, so that the cartridge is biased in a releasing direction from the body by the cushion portion.

9. The cartridge type stationery product according to claim 8, wherein said cushion portion is formed integrally at the insertion end of the cartridge.

10. The cartridge type stationery product according to claim 1, wherein the cartridge is incapable of rotating with respect to the cap when the cap is in the attached state.

11. The cartridge type stationery product according to claim 1, wherein said cap covers all portions of the cartridge that are exposed from the body.

12. The cartridge type stationery product according to claim 1, wherein the body comprises a pair of semi-elliptical thin portions opposing to each other formed at the opening of the body.

13. The cartridge type stationery product according to claim 12, wherein at least one of the pair of semi-elliptical thin portions comprises a notch and the locking groove.

14. The cartridge type stationery product according to claim 12, wherein at least one of the pair of semi-elliptical thin portions comprises a strain relief portion.

15. The cartridge type stationery product according to claim 14, wherein the strain relief portion comprises an opening formed in parallel with the second groove portion.

16. A cartridge type stationery product, comprising a body;

a cartridge attachable to and detachable from the body, the cartridge being insertable in to the body from an opening of the body;

a locking groove formed on one of the cartridge and the body; and a locking protrusion, adapted to be insertable into the locking groove, formed on the other one of the cartridge and the body, wherein said locking groove comprises a first groove portion extending from a vicinity of the opening in a cartridge insertion direction, and a second groove portion extending from the first groove portion so as to form an angle with the first groove portion, a cap is detachably attached to a use tip end portion of the cartridge, which projects from the body, and said cap covers said locking groove and locking protrusion in the attached state.

17. A cartridge type stationery product, comprising a body;

a cartridge attachable to and detachable from the body, the cartridge being insertable in to the body from an opening of the body;

a locking groove formed on one of the cartridge and the body; and a locking protrusion, adapted to be insertable into the locking groove, formed on the other one of the cartridge and the body, wherein said locking groove comprises a first groove portion extending from a vicinity of the opening in a cartridge insertion direction, and a second groove portion extending from the first groove portion so as to form an angle with the first groove portion, a cap is detachably attached to a use tip end portion, which is projected from the body of the cartridge, and said cap includes an ear portion extending to an outside of the body in the attached state, and said ear portion covers said locking groove and said locking protrusion from outside.

18. A cartridge type stationery product, comprising a body;

a cartridge attachable to and detachable from the body, the cartridge being insertable in to the body from an opening of the body;

a locking groove formed on one of the cartridge and the body; and a locking protrusion, adapted to be insertable into the locking groove, formed on the other one of the cartridge and the body, wherein said locking groove comprises a first groove portion extending from a vicinity of the opening in a cartridge insertion direction, and a second groove portion extending from the first groove portion so as to form an angle with the first groove portion, and a cushion portion is provided between an insertion end of the cartridge and an intemal part of the body, so that the cartridge is biased in a releasing direction from the body by the cushion portion.

* * * * *